US011459631B2

(12) United States Patent
Takeda et al.

(10) Patent No.: US 11,459,631 B2
(45) Date of Patent: Oct. 4, 2022

(54) METHOD FOR PRODUCING GALVANNEALED STEEL SHEET, AND CONTINUOUS HOT DIP GALVANIZING APPARATUS

(71) Applicant: JFE STEEL CORPORATION, Tokyo (JP)

(72) Inventors: Gentaro Takeda, Tokyo (JP); Yoichi Makimizu, Tokyo (JP); Yoshikazu Suzuki, Tokyo (JP); Yoshimasa Himei, Tokyo (JP); Hideyuki Takahashi, Tokyo (JP)

(73) Assignee: JFE STEEL CORPORATION, Chiyoda-ku Tokyo (JP)

( * ) Notice: Subject to any disclaimer, the term of this patent is extended or adjusted under 35 U.S.C. 154(b) by 325 days.

(21) Appl. No.: 16/605,305

(22) PCT Filed: Feb. 19, 2018

(86) PCT No.: PCT/JP2018/005809
§ 371 (c)(1),
(2) Date: Oct. 15, 2019

(87) PCT Pub. No.: WO2018/198493
PCT Pub. Date: Nov. 1, 2018

(65) Prior Publication Data

US 2020/0299799 A1 Sep. 24, 2020

(30) Foreign Application Priority Data

Apr. 27, 2017 (JP) ..... JP2017-088837

(51) Int. Cl.
*C21D 9/46* (2006.01)
*C21D 1/26* (2006.01)
(Continued)

(52) U.S. Cl.
CPC ..... *C21D 9/46* (2013.01); *C21D 1/26* (2013.01); *C21D 1/74* (2013.01); *C21D 8/0205* (2013.01);
(Continued)

(58) Field of Classification Search
CPC ..... C21D 1/26; C21D 1/74; C21D 8/0205; C21D 9/005; C21D 9/0062; C21D 9/46;
(Continued)

(56) References Cited

U.S. PATENT DOCUMENTS 9,388,484 B2 7/2016 Takahashi
10,041,140 B2 8/2018 Genaud
(Continued)

FOREIGN PATENT DOCUMENTS

CN 104321447 A 1/2015
CN 104334753 A 2/2015
(Continued)

OTHER PUBLICATIONS

Feb. 1, 2021, Office Action issued by the Korean Intellectual Property Office in the corresponding Korean Patent Application No. 10-2019-7031446 with English language concise statement of relevance.
(Continued)

*Primary Examiner* — Jenny R Wu
(74) *Attorney, Agent, or Firm* — Kenja IP Law PC

(57) ABSTRACT

Provided is a method for producing a galvannealed steel sheet. When the steel sheet passing through the soaking zone is a type of steel containing 0.2 mass % or more of Si, both dry gas and humidified gas are supplied to the soaking zone, where the humidified gas is supplied only from the humidified gas supply port positioned in a latter part of the soaking zone among a plurality of humidified gas supply ports, where the latter part of the soaking zone is determined
(Continued)

considering a sheet passing speed V and a target temperature T on the exit side of the soaking zone.

2 Claims, 2 Drawing Sheets

(51) Int. Cl.

| | |
|---|---|
| ***C21D 1/74*** | (2006.01) |
| ***C21D 8/02*** | (2006.01) |
| ***C21D 9/00*** | (2006.01) |
| ***C22C 38/02*** | (2006.01) |
| ***C23C 2/00*** | (2006.01) |
| ***C23C 2/06*** | (2006.01) |
| ***C23C 2/26*** | (2006.01) |
| ***C23C 2/40*** | (2006.01) |

(52) U.S. Cl.
CPC ..... *C21D 9/005* (2013.01); *C21D 9/0062* (2013.01); *C22C 38/02* (2013.01); *C23C 2/003* (2013.01); *C23C 2/06* (2013.01); *C23C 2/26* (2013.01); *C23C 2/40* (2013.01)

(58) Field of Classification Search
CPC ..... C21D 9/56; C22C 38/02; C23C 2/003; C23C 2/02; C23C 2/06; C23C 2/26; C23C 2/28; C23C 2/40
See application file for complete search history.

(56) References Cited

U.S. PATENT DOCUMENTS

| | | | |
|---|---|---|---|
| 10,752,975 | B2 | 8/2020 | Takeda et al. |
| 2015/0140217 | A1 | 5/2015 | Takahashi et al. |
| 2015/0140218 | A1 | 5/2015 | Takahashi |
| 2016/0363372 | A1 | 12/2016 | Takeda et al. |

FOREIGN PATENT DOCUMENTS

| | | | | | |
|---|---|---|---|---|---|
| CN | 105793446 | A | | 7/2016 | |
| CN | 106029932 | A | | 10/2016 | |
| CN | 106480388 | A | | 3/2017 | |
| CN | 106488994 | A | | 3/2017 | |
| EP | 3112493 | A1 | | 1/2017 | |
| EP | 3276037 | A1 | | 1/2018 | |
| JP | 2013245362 | A | | 12/2013 | |
| JP | 2016017192 | A | | 2/2016 | |
| JP | 2016180136 | A | | 10/2016 | |
| JP | 2016180137 | A | * | 10/2016 | ..... C21D 9/56 |
| JP | 2016180137 | A | | 10/2016 | |
| WO | 2016152018 | A1 | | 9/2016 | |

OTHER PUBLICATIONS

Mar. 5, 2020, the Extended European Search Report issued by the European Patent Office in the corresponding European Patent Application No. 18790515.3.
Jan. 6, 2021, Office Action issued by the China National Intellectual Property Administration in the corresponding Chinese Patent Application No. 201880025211.7 with English language search report.
Mar. 27, 2018, International Search Report issued in the International Patent Application No. PCT/JP2018/005809.

* cited by examiner

METHOD FOR PRODUCING GALVANNEALED STEEL SHEET, AND CONTINUOUS HOT DIP GALVANIZING APPARATUS

TECHNICAL FIELD

This disclosure relates to a continuous hot-dip galvanizing apparatus including an annealing furnace in which a heating zone, a soaking zone and a cooling zone are arranged in the stated order, a hot-dip galvanizing apparatus positioned downstream of the cooling zone, and an alloying line positioned downstream of the hot-dip galvanizing apparatus, and to a method for producing a galvannealed steel sheet using the apparatus.

BACKGROUND

In recent years, the demand for high tensile strength steel sheets which contribute to weight reduction of structures and the like is increasing in the fields of automobiles, household appliances, building materials, etc. It is known that a high tensile strength steel material can produce a steel sheet with good hole expandability by containing Si in the steel, and a steel sheet with good ductility where retained austenite (γ) forms easily by containing Si or Al in the steel, for example.

However, in the case of producing a galvannealed steel sheet using, as a base material, a high tensile strength steel sheet containing a large amount of Si (particularly, 0.2 mass % or more), the following problem arises. The galvannealed steel sheet is produced by heat-annealing a base material steel sheet at a temperature of about 600° C. to 900° C. in a reducing atmosphere or a non-oxidizing atmosphere, then subjecting the steel sheet to hot-dip galvanizing treatment, and further heat-alloying the galvanizing.

Here, Si in the steel is an oxidizable element, and is selectively oxidized even in a typically used reducing atmosphere or non-oxidizing atmosphere and concentrated in the surface of the steel sheet to form oxides. The oxides decrease the wettability with molten zinc during the galvanizing treatment and cause non-coating. Therefore, as the Si concentration in the steel increases, the wettability decreases rapidly and non-coating occurs frequently. Even in the case where non-coating is avoided, there is still a problem of poor coating adhesion. Furthermore, if Si in the steel is selectively oxidized and concentrated in the surface of the steel sheet, a significant alloying delay would arise in the alloying process after the hot-dip galvanizing, which severely disrupts the productivity.

In view of these problems, JP 2016-017192 A (PTL 1) describes a method for producing a galvannealed steel sheet, including a step of conveying a steel sheet to a heating zone having a direct fire furnace (DFF), a soaking zone and a cooling zone in the stated order inside an annealing furnace, and annealing the steel sheet; a step of applying a hot-dip galvanized coating onto the steel sheet discharged from the cooling zone; and a step of heat-alloying the galvanizing, where a mixed gas of humidified gas and dry gas and a dry gas are supplied to the soaking zone; a dry gas is supplied to the cooling zone; and the volume Vr of the soaking zone, the gas flow rate Qrw and the water content Wr of the humidified gas supplied to the soaking zone, the gas flow rate Qrd of the dry gas supplied to the soaking zone, the gas flow rate Qcd of the dry gas supplied to the cooling zone, and the average temperature Tr inside the soaking zone, satisfy a predetermined relationship. This is a technology where the steel sheet surface is sufficiently oxidized using the direct fired furnace in the heating zone, and then the dew point throughout the whole soaking zone is set higher than the dew point of a conventional method to allow sufficient internal oxidation of Si. In this way, the surface concentration of Si is suppressed and the alloying temperature is reduced. With this method, even in the case of subjecting a steel sheet containing 0.2 mass % or more of Si to galvannealing, it is possible to obtain high coating adhesion and a favorable coating appearance, and to suppress the decrease of tensile strength by lowering the alloying temperature.

CITATION LIST

Patent Literature

PTL 1: JP 2016-017192 A

SUMMARY

Technical Problem

However, the method described in PTL 1 focuses only on obtaining a favorable coating appearance in the case of applying a hot-dip galvanized coating onto a high tensile strength steel sheet having a Si content of 0.2 mass % or more, and pays no attention to the case of continuously passing a steel sheet having a Si content of less than 0.2 mass % (hereinafter referred to as "a common steel sheet" in this specification) thereafter. When the type of the steel changes, the desired annealing temperature (temperature on the exit side of the soaking zone) and the dew point of the soaking zone also change. Therefore, it takes time to switch the soaking zone to an optimum low dew point for a common steel sheet having a Si content of less than 0.2 mass % after passing a high tensile strength steel sheet having a Si content of 0.2 mass % or more and supplying a humidified gas to the whole soaking zone to uniformly control the dew point throughout the whole soaking zone to a high dew point, as described in PTL 1. As a result, pick-up defects occur in the annealed common steel sheet before the completion of dew point switching (that is, a tip portion of the steel sheet coil), and it is necessary to cut off the tip portion in subsequent processes, which decreases the yield. In view of this, the method described in PTL 1 still has room for improvement.

It could thus be helpful to provide a method for producing a galvannealed steel sheet and a continuous hot-dip galvanizing apparatus, with which high coating adhesion and a favorable coating appearance can be obtained in the case of applying a hot-dip galvanized coating onto a steel sheet having a Si content of 0.2 mass % or more, and at the same time, the dew point of the atmosphere in the soaking zone can be rapidly switched so that the occurrence of pick-up defects can be suppressed in the case of subsequently applying a hot-dip galvanized coating onto a steel sheet having a Si content of less than 0.2 mass % thereafter.

Solution to Problem

This disclosure aims at (A) suppressing the concentration of Si oxide in the steel sheet surface and obtaining good adhesion when passing a high tensile strength steel sheet having a Si content of 0.2 mass % or more, and (B) suppressing the occurrence of pick-up defects by rapidly switching the dew point of the atmosphere in the soaking zone when subsequently passing a common steel sheet having a Si content of less than 0.2 mass % thereafter, at the same time. According our study, it was found that (A) can be achieved as long as a humidified gas is particularly supplied to a latter part of the soaking zone where the steel sheet reaches a highest temperature, and it is unnecessary to supply a humidified gas to the whole soaking zone to increase the dew point. When the humidified gas is only supplied to the latter part of the soaking zone instead of the whole soaking zone, the dew point inside the soaking zone can be rapidly lowered when passing a type of steel which requires no humidified gas supply, thereby achieving (B). In addition, according to our study, it is important to determine the range of the latter part of the soaking zone, where the humidified gas should be supplied during the passage of a high tensile strength steel sheet, in consideration of a sheet passing speed V and a target temperature T on the exit side of the soaking zone. In this way, it is possible to achieve both (A) and (B).

The primary features of this disclosure, which was developed based on the above findings, are as follows.

[1] A method for producing a galvannealed steel sheet using a continuous hot-dip galvanizing apparatus comprising a vertical annealing furnace in which a heating zone, a soaking zone and a cooling zone are arranged in the stated order, a hot-dip galvanizing apparatus positioned downstream of the cooling zone, and an alloying line positioned downstream of the hot-dip galvanizing apparatus, wherein the method comprises conveying a steel sheet inside the annealing furnace through the heating zone, the soaking zone, and the cooling zone in the stated order, and performing annealing on the steel sheet, where the steel sheet is conveyed vertically a plurality of times inside each zone to form a plurality of passes, applying a hot-dip galvanized coating onto the steel sheet discharged from the cooling zone using the hot-dip galvanizing apparatus, and heat-alloying the galvanized coating applied onto the steel sheet using the alloying line, wherein a plurality of humidified gas supply ports for supplying a reducing or a non-oxidizing humidified gas to the soaking zone, and at least one dry gas supply port for supplying a reducing or a non-oxidizing dry gas to the soaking zone are arranged in the soaking zone, and in a case where the steel sheet passing through the soaking zone is a type of steel containing 0.2 mass % or more of Si, both the dry gas and the humidified gas are supplied to the soaking zone, wherein the humidified gas is supplied only from a humidified gas supply port positioned in a latter part of the soaking zone among the plurality of humidified gas supply ports, where the latter part of the soaking zone is an area on the cooling zone side of a pass immediately upstream of a pass including a most upstream position of a steel sheet portion corresponding to L, where L is determined so as to satisfy the following expression (1)

$$1.0 \leq 10100 L/V \exp\{-14560/(T+273.15)\} \leq 2.5 \quad (1)$$

where L[m] is a steel sheet length from an exit side of the soaking zone, V[m/s] is a sheet passing speed, and T[° C.] is a target temperature on the exit side of the soaking zone.

[2] The method for producing a galvannealed steel sheet according to [1], wherein in the case where the steel sheet passing through the soaking zone is a type of steel containing 0.2 mass % or more of Si, a dew point of furnace gas collected from a dew point measurement port positioned in the latter part of the soaking zone is controlled to −25° C. or higher and 0° C. or lower.

[3] A continuous hot-dip galvanizing apparatus for carrying out the method for producing a galvannealed steel sheet according to [1] or [2], comprising an annealing furnace in which a heating zone, a soaking zone, and a cooling zone are arranged in the stated order, a hot-dip galvanizing apparatus positioned downstream of the cooling zone, an alloying line positioned downstream of the hot-dip galvanizing apparatus, and a plurality of humidified gas supply ports for supplying a reducing or a non-oxidizing humidified gas to the soaking zone, and at least one dry gas supply port for supplying a reducing or a non-oxidizing dry gas to the soaking zone arranged in the soaking zone, wherein each of the plurality of humidified gas supply ports has a regulating valve capable of independently controlling supply and shutoff of the humidified gas and a gas flow rate.

Advantageous Effect

According to the method for producing a galvannealed steel sheet and the continuous hot-dip galvanizing apparatus of this disclosure, it is possible to obtain high coating adhesion and a favorable coating appearance in the case of applying a hot-dip galvanized coating onto a steel sheet having a Si content of 0.2 mass % or more, and at the same time, to suppress the occurrence of pick-up defects by rapidly switching the dew point of the atmosphere in the soaking zone in the case of subsequently applying a hot-dip galvanized coating onto a steel sheet having a Si content of less than 0.2 mass % thereafter.

DETAILED DESCRIPTION

Figure 1:
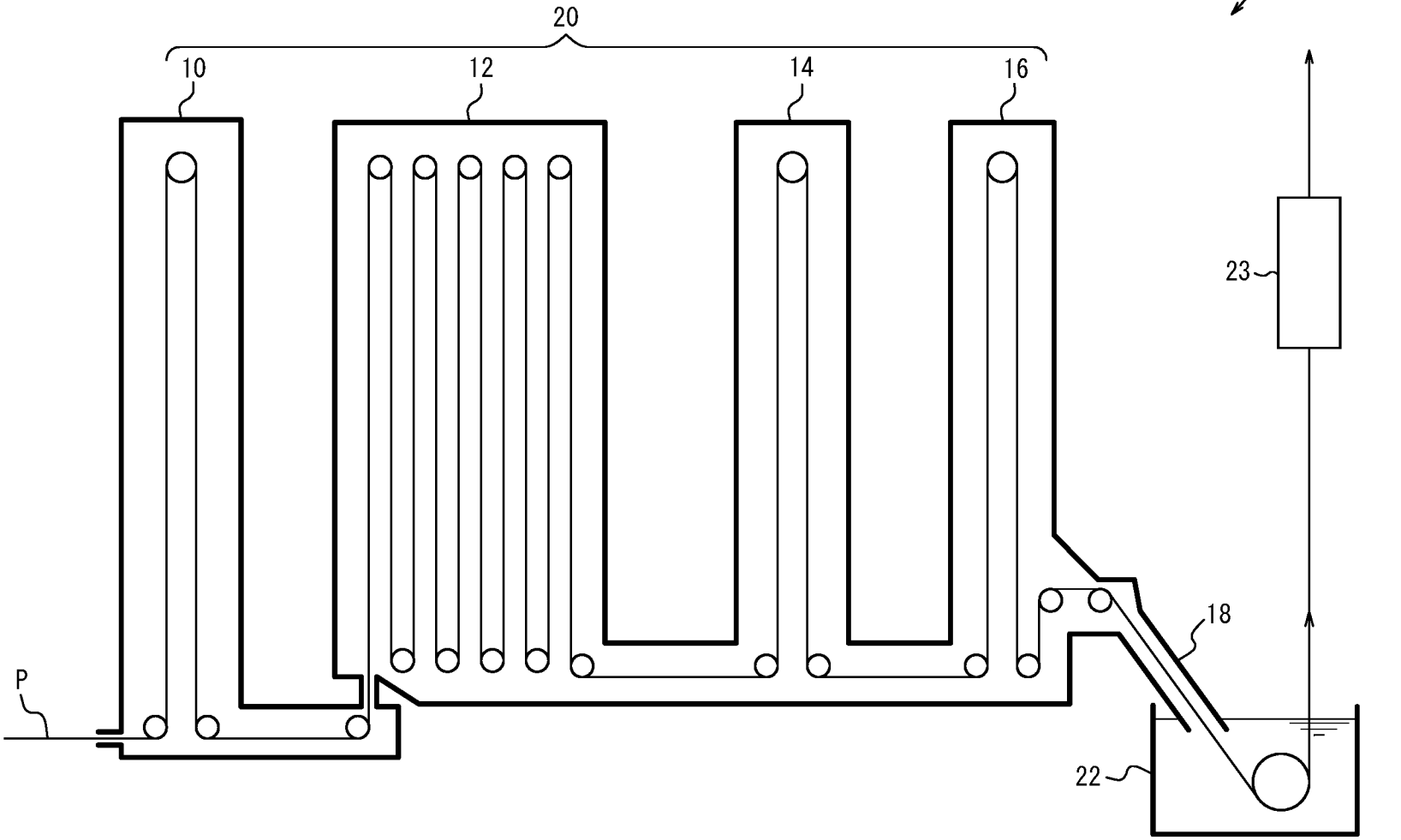
FIG. 1 is a schematic view illustrating the structure of a continuous hot-dip galvanizing apparatus 100 used in an embodiment of this disclosure.

The structure of a continuous hot-dip galvanizing apparatus 100 used in a method for producing a galvannealed steel sheet according to one embodiment of this disclosure is described first, with reference to FIG. 1. The continuous hot-dip galvanizing apparatus 100 includes a vertical annealing furnace 20 in which a heating zone 10, a soaking zone 12 and cooling zones 14 and 16 are arranged in the stated order, a hot-dip galvanizing bath 22 positioned downstream of the cooling zone 16 in the steel sheet passing direction as a hot-dip galvanizing apparatus, and an alloying line 23 positioned downstream of the hot-dip galvanizing bath 22 in the steel sheet passing direction. The cooling zone of this embodiment includes a first cooling zone 14 (rapid cooling zone) and a second cooling zone 16 (slow cooling zone). A snout 18 connected to the second cooling zone 16 has its tip immersed in the hot-dip galvanizing bath 22, thereby connecting the annealing furnace 20 and the hot-dip galvanizing bath 22.

A steel sheet P is introduced into the heating zone 10 from a steel sheet introduction port in the lower part of the heating zone 10. One or more hearth rolls are arranged in the upper and lower parts in each of the zones 10, 12, 14 and 16. In the case where the steel sheet P is folded back by 180 degrees at one or more hearth rolls, the steel sheet P is conveyed vertically a plurality of times inside the corresponding predetermined zone of the annealing furnace 20, forming a plurality of passes. FIG. 1 illustrates an example of having two passes in the heating zone 10, ten passes in the soaking zone 12, two passes in the first cooling zone 14, and two passes in the second cooling zone 16. However, the numbers of passes are not limited to such, and may be set as appropriate according to the processing conditions. At some hearth rolls, the steel P is not folded back but changed in direction at the right angle to move to the next zone. The steel sheet P is thus annealed inside the annealing furnace 20 by being conveyed through the heating zone 10, the soaking zone 12, and the cooling zones 14 and 16 in the stated order.

Each of the zones 10, 12, 14 and 16 is a vertical furnace, where the height is not particularly limited and may be about 20 m to 40 m. In addition, the length of each zone (horizontal direction in FIG. 1) may determined as appropriate according to the number of passes in each zone. For example, the heating zone 10 with two passes may be about 0.8 m to 2 m, the soaking zone 12 with ten passes may be about 10 m to 20 m, and the first cooling zone 14 and the second cooling zone 16 each with two passes may each be about 0.8 m to 2 m.

Adjacent zones in the annealing furnace 20 communicate through a communication portion connecting the upper parts or lower parts of the respective zones. In this embodiment, the heating zone 10 and the soaking zone 12 communicate through a throat (restriction portion) connecting the lower parts of the respective zones. The soaking zone 12 and the first cooling zone 14 communicate through a throat connecting the lower parts of the respective zones. The first cooling zone 14 and the second cooling zone 16 communicate through a throat connecting the lower parts of the respective zones. The height of each throat may be set as appropriate. However, from the viewpoint of enhancing the independence of the atmosphere of each zone, it is preferable that the height of each throat be as low as possible. The gas in the annealing furnace 20 flows from downstream to upstream in the furnace, and is discharged from the steel sheet introduction port in the lower part of the heating zone 10.

(Heating Zone)

In this embodiment, the heating zone 10 is capable of indirectly heating the steel sheet P using a radiant tube (RT) or an electric heater. The average temperature inside the heating zone 10 is preferably 700° C. to 900° C. In the heating zone 10, a reducing gas or a non-oxidizing gas is separately supplied while a gas flowing in from the soaking zone 12. As the reducing gas, a $H_2$—$N_2$ mixed gas is typically used. Examples thereof include a gas (dew point: about −60° C.) having a composition containing 1 vol. % to 20 vol. % $H_2$ with the balance being $N_2$ and inevitable impurities. In addition, examples of the non-oxidizing gas include a gas (dew point: about −60° C.) having a composition containing $N_2$ and inevitable impurities. The gas supply to the heating zone 10 is not particularly limited. However, the gas is preferably supplied from two or more introduction ports in the height direction and one or more introduction ports in the length direction so as to be uniformly introduced into the heating zone. The flow rate of the gas supplied to the heating zone is measured by a gas flow meter (not illustrated) provided in a pipe. The flow rate of the gas is not particularly limited, and may be about 10 to 100 ($Nm^3$/hr).

(Soaking Zone)

In this embodiment, the soaking zone 12 is capable of indirectly heating the steel sheet P using a radiant tube (not illustrated) as a heating means. The average temperature inside the soaking zone 12 is preferably 700° C. to 1000° C.

A reducing gas or a non-oxidizing gas is supplied to the soaking zone 12. As the reducing gas, a $H_2$—$N_2$ mixed gas is typically used. Examples thereof include a gas (dew point: about −60° C.) having a composition containing 1 vol. % to 20 vol. % of $H_2$ with the balance being $N_2$ and inevitable impurities. In addition, examples of the non-oxidizing gas include a gas (dew point: about −60° C.) having a composition containing $N_2$ and inevitable impurities.

In this embodiment, the reducing gas or the non-oxidizing gas supplied to the soaking zone 12 has two forms, namely, humidified gas and dry gas. Here, "dry gas" is the reducing gas or the non-oxidizing gas having a dew point of about −60° C. to −50° C. which is not humidified by a humidifying device, and "humidified gas" is the gas which has been humidified to a dew point of 0° C. to 30° C. by a humidifying device.

Figure 2:
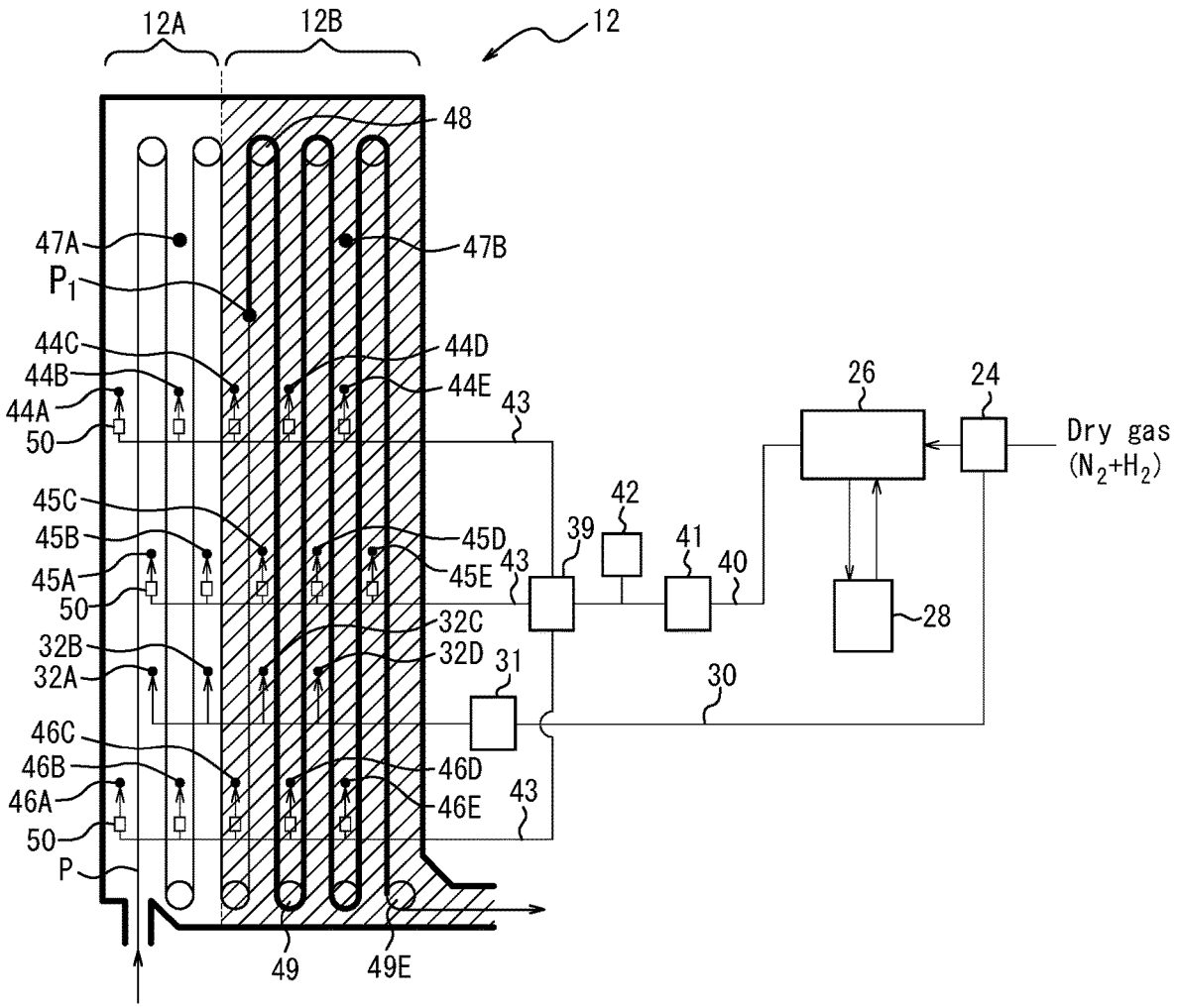
FIG. 2 is a schematic view illustrating a system of supplying a humidified gas and a dry gas to the soaking zone 12 of FIG. 1.

FIG. 2 is a schematic view illustrating systems of supplying humidified gas and dry gas to the soaking zone 12. The humidified gas is supplied via three systems, namely, humidified gas supply ports 44A to 44E, humidified gas supply ports 45A to 45E, and humidified gas supply ports 46A to 46E. In FIG. 2, the reducing gas or the non-oxidizing gas (dry gas) is partially sent to a humidifying device 26 by a dry gas distribution device 24, and the rest passes through a dry gas pipe 30 as dry gas and supplied into the soaking zone 12 via dry gas supply ports 32A, 32B, 32C and 32D.

The position and the number of the dry gas supply ports are not particularly limited, and may be determined as appropriate in consideration of various conditions. However, it is preferable that a plurality of dry gas supply ports be arranged at the same height position along the length direction of the soaking zone, and it is preferable that the dry gas supply ports be arranged evenly in the length direction of the soaking zone.

The gas humidified by the humidifying device 26 passes through a humidified gas pipe 40 and is distributed to the three systems by a humidified gas distribution device 39 and supplied into the soaking zone 12 via the humidified gas supply ports 44A to 44E, the humidified gas supply ports 45A to 45E, and the humidified gas supply ports 46A to 46E through a humidified gas pipe 43 respectively.

The position and the number of the humidified gas supply ports are not particularly limited, and may be determined as appropriate in consideration of various conditions. However, it is preferable that a plurality of humidified gas supply ports be arranged at the same height position along the length direction of the soaking zone, and it is preferable that the humidified gas supply ports be arranged evenly in the length direction of the soaking zone. In addition, it is preferable that one or more rows of humidified gas supply ports along the length direction of the soaking zone be provided in each of two areas divided in the vertical direction of the soaking zone 12. In this way, the dew point can be uniformly control throughout the soaking zone 12. Reference numeral 41 is a humidified gas flow meter, and reference numeral 42 is a humidified gas dew point meter.

The humidifying device 26 includes a humidifying module having a fluorine-based or polyimide-based hollow fiber membrane, flat membrane, or the like. Dry gas flows inside the membrane, whereas pure water adjusted to a predetermined temperature in a constant-temperature circulating water bath 28 circulates outside the membrane. The fluorine-based or polyimide-based hollow fiber membrane or flat membrane is a type of ion exchange membrane having affinity to water molecules. When a difference in water concentration occurs between the inside and the outside of the hollow fiber membrane, a force is generated to equalize the difference in concentration. This force works as a driving force, so that water moves through the membrane toward the part with a lower water concentration. The dry gas temperature changes as air temperature changes seasonally or daily. In this humidifying device, however, heat exchange can be realized by ensuring a sufficient contact area between gas and water via a vapor permeable membrane. Accordingly, regardless of whether the dry gas temperature is higher or lower than the circulating water temperature, the dry gas is humidified to the same dew point as the set water temperature, thus achieving highly accurate dew point control. The dew point of the humidified gas can be controlled to any value in the range of 5° C. to 50° C. If the dew point of the humidified gas is higher than the pipe temperature, condensation occurs in the pipe and the condensed water may directly infiltrate into the furnace. Therefore, the humidified gas pipe is heated and kept at a temperature no lower than the dew point of the humidified gas and no lower than the outside air temperature.

Here, in the case of producing a high tensile strength steel sheet having a chemical composition containing 0.2 mass % or more of Si, the humidified gas is supplied to the soaking zone 12 in addition to the dry gas in order to raise the dew point inside the soaking zone. On the other hand, in the case of producing a steel sheet having a Si content of less than 0.2 mass % (for example, a common steel sheet having a tensile strength of about 270 MPa), only the dry gas is supplied to the soaking zone 12, and no mixed gas is supplied.

This embodiment is characterized in that, when a high tensile strength steel sheet having a Si content of 0.2 mass % or more is passed, the humidified gas is supplied only from a latter part of the soaking zone where the steel sheet reaches a highest temperature, and the range of the latter part of the soaking zone is determined in consideration of a sheet passing speed V and a target temperature T on the exit side of the soaking zone. The following describes the technical significance of adopting such a characteristic structure. In order to enable such humidified gas supply control, all the humidified gas supply ports in this embodiment are independent of one another and have a regulating valve 50 that can control the supply and shutoff of humidified gas and the gas flow rate, as illustrated in FIG. 2.

The steel sheet temperature on the exit side of the heating zone is set to about 300° C. to 500° C. lower than the steel sheet temperature (annealing temperature) on the exit side of the soaking zone. For example, when the steel sheet temperature on the exit side of the soaking zone is 850° C., the steel sheet temperature on the exit side of the heating zone is about 350° C. to 550° C., and the steel sheet is heated to 300° C. to 500° C. in a former part of the soaking zone. On the other hand, Si added to the steel is more concentrated in the steel sheet surface as the temperature is higher than 700° C. It was found that, in order to suppress the concentration in surface, the dew point of the area of the latter part of the soaking zone where the steel sheet reaches a highest temperature may be set to −25° C. to 0° C., and that Si promotes the formation of oxides inside the steel sheet and has the effect of improving coating adhesion and promoting alloying reaction. In addition, it was found that the range of the latter part of the soaking zone where the humidified gas should be supplied can be determined based on the following expression (1).

$$1.0 \leq 10100 L/V \exp\{-14560/(T+273.15)\} \leq 2.5 \quad (1)$$

L[m]: steel sheet length from the exit side of the soaking zone

V[m/s]: sheet passing speed

T[° C.]: target temperature on the exit side of the soaking zone

Here, the sheet passing speed V and the target temperature T on the exit side of the soaking zone are determined in advance when a high tensile strength steel sheet having a Si content of 0.2 mass % or more is passed. Usually, the sheet passing speed V is determined from the range of 1.0 m/s to 2.0 m/s in consideration of, for example, the thickness of the steel sheet, and the target temperature T on the exit side of the soaking zone is determined from the range of 750° C. to 900° C. in consideration of, for example, the chemical composition of the steel sheet. The "target temperature on the exit side of the soaking zone" is a target temperature of the steel sheet on the exit side of the soaking zone set based on the material control of steel sheet, and the temperature inside the soaking zone is controlled so that the steel sheet temperature measured by a radiation thermometer reaches the target temperature.

Then, the sheet passing speed V and the target temperature T on the exit side of the soaking zone, which are determined in advance, are substituted into the expression (1), and the steel sheet length L from the exit side of the soaking zone is determined so as to satisfy the expression (1). The steel sheet length L from the exit side of the soaking zone is the steel sheet length from a lower hearth roll 49E on the exit side of the soaking zone which is located most downstream among the lower hearth rolls 49 of the soaking zone, with reference to FIG. 2. In addition, the area on the cooling zone side of the pass immediately upstream of the pass corresponding to the most upstream position of the steel sheet portion corresponding to determined L is defined as the latter part of the soaking zone. Referring to FIG. 2, $P_1$ indicates the most upstream position of the steel sheet portion of the length L from the exit side of the soaking zone. The area on the cooling zone side, namely the downstream side in the length direction of the soaking zone, of the pass (the fourth pass in FIG. 2) immediately upstream of the pass (the fifth pass in FIG. 2) corresponding to the most upstream position $P_1$ is the latter part 12B of the soaking zone. The area on the heating zone side, namely the upstream side in the length direction of the soaking zone, of the pass (the fourth pass in FIG. 2) immediately upstream of the pass corresponding to the most upstream position $P_1$ is the former part 12A of the soaking zone. In this embodiment, the humidified gas is supplied only from the humidified gas supply ports located at the latter part 12B of the soaking zone (in FIG. 2, the humidified gas supply ports 44C to 44E in the upper part, the humidified gas supply ports 45C to 45E in the middle part, and the humidified gas supply ports 46C to 46E in the lower part) among the plurality of humidified gas supply ports. In this way, (A) when a high tensile strength steel sheet having a Si content of 0.2 mass % or more is passed, it is possible to suppress the concentration of Si oxides in the surface of the steel sheet and achieve good adhesion, and (B) when a common steel sheet having a Si content of less than 0.2 mass % is passed immediately after the high tensile strength steel sheet, it is possible to suppress the occurrence of pick-up defects by rapidly switching the dew point of the atmosphere in the soaking zone. According to the definition of the latter part of the soaking zone, humidified gas is supplied to the front and back of the steel sheet on the pass corresponding to the most upstream position $P_1$ of the steel sheet portion of length L from the exit side of the soaking zone.

Setting the value of the second part of the expression (1) to 1.0 or more is a necessary condition to secure minimum required internal oxidation of Si. Therefore, if the value of the second part is less than 1.0, the internal oxidation of Si proceeds insufficiently when a high tensile strength steel sheet having a Si content of 0.2 mass % or more is passed, and it is impossible to obtain high coating adhesion or favorable coating appearance. In addition, the alloying temperature increases and the tensile strength decreases. Therefore, in this embodiment, the value of the second part is 1.0 or more.

On the other hand, setting the value of the second part to 2.5 or less is a necessary condition for rapidly switching the atmosphere in the soaking zone. Therefore, if the value of the second part exceeds 2.5, it takes time to change the dew point when a Si-added high tensile strength steel sheet is switched to a common steel sheet, and surface defects such as pick-up defects occur during the common steel sheet production. In addition, the effect of improving coating adhesion and promoting alloying reaction is saturated even if the value of the second part exceeds 2.5 and the humidifying area is elongated. Therefore, in this embodiment, the value of the second part is 2.5 or less.

For example, the following can be set in actual operation. For example, in the case of sheet passing speed V=2.0 m/s, if the target temperature T on the exit side of the soaking zone=750° C., then the steel sheet length from the exit side of the soaking zone satisfying the expression (1) is 301 m≤L≤750 m; if the target temperature T on the exit side of the soaking zone=800° C., then the steel sheet length from the exit side of the soaking zone satisfying the expression (1) is 155 m≤L≤387 m. In the case where the sheet passing speed is required to keep at 2.0 m/s during the operation, the latter part of the soaking zone is set with L=301 m, for example, so as to satisfy 301 m≤L≤387 m. In this way, it is possible to perform an operation satisfying the expression (1) regardless of whether the target temperature T on the exit side of the soaking zone is 750° C. or 800° C., so that it is unnecessary to make major operating condition changes other than changing the target temperature T.

In addition, in the case of sheet passing speed V=1.0 m/s, if the target temperature T on the exit side of the soaking zone=750° C., the steel sheet length from the exit side of the soaking zone satisfying the expression (1) is 151 m≤L≤375 m. Therefore, after performing an operation where the sheet passing speed=2.0 m/s and the target temperature T on the exit side of the soaking zone=800° C. (an operation where L satisfying the expression (1) is in the range of 155 m to 387 m), if it is desired to perform an operation where the target temperature T on the exit side of the soaking zone is changed to 750° C., L can be fixed to 155 m or more by setting the sheet passing speed to 1.0 m/s. In other words, there is no need to expand the latter part of the soaking zone, which is preferable from the viewpoint of speeding up the atmosphere switching.

The flow rate of the humidified gas supplied into the soaking zone 12 is not particularly limited as long as it is controlled as described above. However, it is maintained in the range of about 100 to 400 ($Nm^3$/hr). The flow rate of the dry gas supplied into the soaking zone 12 is not particularly limited. However, it is maintained in the range of about 10 to 300 ($Nm^3$/hr) when a high tensile strength steel sheet having a chemical composition containing 0.2 mass % or more of Si is passed, and it is maintained in the range of 200 to 600 ($Nm^3$/hr) when a steel sheet having a Si content of less than 0.2 mass % (for example, a common steel sheet with a tensile strength of about 270 MPa) is passed.

(Cooling Zone)

In this embodiment, the steel sheet P is cooled in the cooling zones 14 and 16. The steel plate P is cooled to about 480° C. to 530° C. in the first cooling zone 14 and to about 470° C. to 500° C. in the second cooling zone 16.

The cooling zones 14 and 16 are also supplied with a reducing gas or a non-oxidizing gas, and only dry gas is supplied. The supply of dry gas to the cooling zones 14 and 16 is not particularly limited. However, the dry gas is preferably supplied from two or more introduction ports in the height direction and two or more introduction ports in the longitudinal direction so as to be uniformly introduced into the cooling zones. The total gas flow rate of the dry gas supplied to the cooling zones 14 and 16 is measured by a gas flow meter (not illustrated) provided in a pipe. The total flow rate is not particularly limited, and may be about 200 to 1000 ($Nm^3$/hr).

(Hot-Dip Galvanizing Bath)

The hot-dip galvanizing bath 22 can be used to apply a hot-dip galvanized coating onto the steel sheet P discharged from the second cooling zone 16. The hot-dip galvanized coating may be applied with a usual method.

(Alloying Line)

The alloying line 23 can be used to heat-alloy the galvanizing applied on the steel sheet P. The alloying treatment may be performed with a usual method. In this embodiment, the alloying temperature is kept from being high, so that the decrease of tensile strength in the resulting galvannealed steel sheet can be suppressed.

(Chemical Composition of Steel Sheet)

The steel sheet P to be subjected to annealing and hot-dip galvanizing treatment is not particularly limited. However, in the case of a steel sheet having a chemical composition containing 0.2 mass % or more of Si, namely, high tensile strength steel, the effects of this disclosure can be advantageously obtained. The following describes a suitable chemical composition of the steel sheet. In the following description, all the units indicated by "%" refer to "mass %".

The C content is preferably 0.025% or more because C facilitates the improvement of processability by forming a retained austenite layer or a martensitic phase as the steel microstructure. However, this disclosure does not particularly define a lower limit. On the other hand, if the C content exceeds 0.3%, the weldability deteriorates. Therefore, the C content is preferably 0.3% or less.

Si is an element effective in strengthening the steel and obtaining good material properties, and therefore a high tensile strength steel sheet is added with 0.2% or more of Si. If the Si content is less than 0.2%, expensive alloying elements are required in order to obtain high strength. On the other hand, if the Si content exceeds 2.5%, oxide coating formation in the oxidation treatment is suppressed. In addition, the alloying temperature is increased, rendering it difficult to obtain desired mechanical properties. Therefore, the Si content is preferably 2.5% or less.

Mn is an element effective in strengthening the steel. The Mn content is preferably 0.5% or more in order to secure a tensile strength of 590 MPa or more. On the other hand, if the Mn content exceeds 3.0%, it may be difficult to secure weldability, coating adhesion, and strength-ductility balance. Therefore, the Mn content is preferably 0.5% to 3.0%. In the case of a tensile strength of 270 MPa to 440 MPa, Mn is appropriately added in a content of 1.5% or less.

P is an element effective in strengthening the steel. However, in the case of steel having a Si content of 0.2% or more, the P content is preferably 0.03% or less because it delays the alloying reaction between zinc and the steel. It may be appropriately added according to the strength in other cases.

Although S has little influence on the steel strength, it affects oxide coating formation during hot rolling and cold rolling. Therefore, the S content is preferably 0.005% or less.

In addition to the aforementioned elements, one or more of elements such as Cr, Mo, Ti, Nb, V, and B can be optionally added, for example. The remaining balance is Fe and inevitable impurities.

EXAMPLES (Experimental Conditions)

The continuous hot-dip galvanizing apparatus illustrated in FIGS. 1 and 2 was used to anneal four types of steel sheets whose chemical composition was as listed in Table 1 under various annealing conditions, and then subject the steel sheets to hot-dip galvanizing and alloying treatment. Steels B and C are high tensile strength steels, and steels A and D are common steels. As indicated in Table 2, steels A, B, C and D were continuously passed in the stated order in examples of Nos. 1 to 4. The sheet passing speed is listed in Table 1.

The heating zone was a RT furnace with a volume of 200 $m^3$. The average temperature inside the heating zone was 700° C. to 800° C. In the heating zone, a gas (dew point: −50° C.) having a composition containing 15 vol. % of $H_2$ with the balance being $N_2$ and inevitable impurities was used as a dry gas. The flow rate of the dry gas to the heating zone was 100 $Nm^3$/hr.

The soaking zone was a RT furnace with a volume of 700 $m^3$. A gas (dew point: −50° C.) having a composition containing 15 vol. % of $H_2$ with the balance being $N_2$ and inevitable impurities was used as a dry gas. Part of the dry gas was humidified by a humidifying device having a hollow fiber membrane-type humidifying portion, to prepare a humidified gas. The hollow fiber membrane-type humidifying portion was made up of 10 membrane modules, and a maximum of 500 L/min of dry gas and a maximum of 20 L/min of circulating water were allowed to flow in each module. A common constant-temperature circulating water bath capable of supplying a total of 200 L/min of pure water was used.

Dry gas supply ports and humidified gas supply ports were arranged at the positions illustrated in FIG. 2. That is, humidified gas introduction ports were provided at five locations along the length direction of the soaking zone in each of the upper, middle and lower parts of the soaking zone corresponding to hearth roll arrangement in the furnace (five upper hearth rolls and five lower hearth rolls), i.e. humidified gas instruction ports were provided at a total of 15 locations in five rows (three locations per row) in the vertical direction of the soaking zone, and each humidified gas supply port was provided with an on-off valve so that each humidified gas supply port could independently control the supply of humidified gas. The length between the upper hearth rolls and the lower hearth rolls of the soaking zone was 30 m, and one row of humidified gas introduction ports worked as the humidifying area of a steel sheet length of 60 m (2 passes).

The target temperature on the exit side of the soaking zone and the target dew point inside the soaking zone during the passage of steels A to D are listed Table 1. In addition, the dry gas was supplied at the flow rate listed in Table 2 to the soaking zone during the passage of each steel. Furthermore, the humidified gas was only supplied from the humidified gas supply port positioned in a latter part of the soaking zone determined based on L listed in Table 2, and the total flow rate was as listed in Table 2. The "number of humidified gas introduction rows" in Table 2 indicates the number of rows of humidified gas supply ports at the latter part of the soaking zone among the five rows along the vertical direction of the soaking zone. As illustrated in FIG. 2, with regard to the positions of the humidified gas supply ports, the humidified gas supply ports 44A to 44E of the upper part and the humidified gas supply ports 46A to 46E of the lower part were arranged at the same position in the length direction of the soaking zone, while the humidified gas supply ports 45A to 45E of the middle part were arranged at a position shifted by half pitch in the length direction of the soaking zone. In this way, the surface of the steel sheet could be uniformly humidified. Note that 44A, 45A and 46A are taken as one row in counting the number of introduction rows. The same applies to the symbols B to E.

The "former part dew point" and the "latter part dew point" columns of the soaking zone in Table 2 respectively indicate the dew point in the soaking zone measured at the positions of dew point measurement ports 47A and 47B in FIG. 2. The "measured steel sheet temperature on exit side" in Table 2 is the steel sheet temperature measured on the exit side of the soaking zone. In addition, the "humidified gas dew point" indicates the dew point measured by the humidified gas dew point meter 42 in FIG. 2.

The dry gas (dew point: −50° C.) was supplied to the first cooling zone and the second cooling zone from the lowermost part of each zone at the flow rate listed in Table 2.

The galvanizing bath temperature was 460° C., the Al concentration in the galvanizing bath was 0.130%, and the coating weight was adjusted to 50 g/$m^2$ per side by gas wiping. After the hot-dip galvanizing, alloying treatment was performed in an induction heating-type alloying furnace so that the coating alloying degree (Fe content) was 10% to 13%. The alloying temperature during the treatment is listed in Table 2.

(Evaluation Method)

The evaluation of the coating appearance was conducted through inspection by an optical surface defect meter (detection of non-coating defects or roll pick-up defects of ϕ0.5 or more) and visual determination of alloying unevenness. Those accepted on all criteria were rated "good", those having a low degree of alloying unevenness were rated "fair", and those rejected on at least one of the criteria were rated "poor". The results are listed in Table 2.

In addition, the tensile strength of the galvannealed steel sheets produced under various conditions was measured. It was accepted when the steel A was 270 MPa or more, the steel B was 780 MPa or more, the steel C was 980 MPa or more, and the steel D was 340 MPa or more. The results are listed in Table 2.

TABLE 1

| (mass %) | | | | | | | | |
|---|---|---|---|---|---|---|---|---|
| | | | | | | Target temperature in soaking zone | | |
| | Chemical composition | | | | | Exit side temperature | Former part dew point | Latter part dew point |
| Steel | C | Si | Mn | P | S | (° C.) | (° C.) | (° C.) |
| A | 0.08 | 0.01 | 0.2 | 0.02 | 0.001 | 740 ± 20 | −50 to −30 | −50 to −30 |
| B | 0.10 | 0.2 | 2.4 | 0.02 | 0.001 | 800 ± 15 | −25 to −15 | −15 to −5 |
| C | 0.11 | 1.5 | 2.7 | 0.01 | 0.001 | 830 ± 15 | −20 to −10 | −10 to 0 |
| D | 0.08 | 0.03 | 0.4 | 0.04 | 0.001 | 780 ± 20 | −50 to −30 | −50 to −30 |

Balance: Fe and inevitable impurities

TABLE 2

| | | | | Soaking zone | | | | | | | |
|---|---|---|---|---|---|---|---|---|---|---|---|
| No. | Steel | Sheet width (m) | Sheet passing speed V (m/s) | Former part dew point (° C.) | Latter part dew point (° C.) | Target steel sheet temperature on exit side T (° C.) | Measured steel sheet temperature on exit side (° C.) | Dry gas flow rate ($Nm^3$/hr) | Humidified gas flow rate ($Nm^3$/hr) | Humidified gas dew point (° C.) | Number of humidified gas introduction rows |
| 1 | A | 1.2 | 1.6 | −38.2 | −36.5 | 740 | 745 | 440 | 0 | — | 0 |
| | B | 1.0 | 1.6 | −45.2 | −46.3 | 800 | 802 | 430 | 0 | — | 0 |
| | C | 1.0 | 1.6 | −47.1 | −49.5 | 830 | 833 | 435 | 0 | — | 0 |
| | D | 1.5 | 1.6 | −40.7 | −41.0 | 780 | 785 | 420 | 0 | — | 0 |
| 2 | A | 1.2 | 1.6 | −39.1 | −38.3 | 740 | 741 | 435 | 0 | — | 0 |
| | B | 1.0 | 1.6 | −20.3 | −10.5 | 800 | 800 | 270 | 150 | 19 | 3 |
| | C | 1.0 | 1.6 | −12.2 | −8.2 | 830 | 830 | 100 | 320 | 19 | 3 |
| | D | 1.5 | 1.6 | −34.9 | −32.1 | 780 | 780 | 430 | 0 | — | 0 |
| 3 | A | 1.2 | 1.2 | −36.3 | −37.5 | 740 | 741 | 435 | 0 | — | 0 |
| | B | 1.0 | 1.2 | −22.2 | −13.2 | 800 | 804 | 270 | 80 | 19 | 2 |
| | C | 1.0 | 1.2 | −13.5 | −8.2 | 830 | 840 | 160 | 260 | 19 | 2 |
| | D | 1.5 | 1.2 | −32.2 | −33.4 | 780 | 779 | 430 | 0 | — | 0 |
| 4 | A | 1.2 | 1.2 | −36.3 | −37.5 | 740 | 741 | 435 | 0 | — | 0 |
| | B | 1.0 | 1.2 | −24.1 | −13.2 | 800 | 802 | 270 | 80 | 19 | 1 |
| | C | 1.0 | 1.5 | −12.9 | −7.2 | 830 | 840 | 100 | 320 | 19 | 4 |
| | D | 1.5 | 1.5 | −26.6 | −24.3 | 780 | 779 | 430 | 0 | — | 0 |

| | Soaking zone | | | Cooling zone | Alloying treatment | | Material strength | | |
|---|---|---|---|---|---|---|---|---|---|
| No. | Humidifying area L (m) | Second part of expression (1) | Expression (1) | Gas flow rate ($Nm^3$/hr) | Alloying temperature (° C.) | Coating appearance | Tensile strength (MPa) | Pass or fail | Category |
| 1 | 0 | 0.00 | — | 550 | 495 | Good | 298 | Pass | Comparative example |
| | 0 | 0.00 | Unsatisfied | 550 | 550 | Poor | 752 | Fail | |
| | 0 | 0.00 | Unsatisfied | 550 | 562 | Poor | 962 | Fail | |
| | 0 | 0.00 | — | 550 | 490 | Good | 368 | Pass | |
| 2 | 0 | 0.00 | — | 550 | 495 | Good | 302 | Pass | Example |
| | 180 | 1.46 | Satisfied | 550 | 510 | Good | 802 | Pass | |
| | 180 | 2.11 | Satisfied | 550 | 503 | Good | 1010 | Pass | |
| | 0 | 0.00 | — | 550 | 490 | Good | 360 | Pass | |
| 3 | 0 | 0.00 | — | 550 | 495 | Good | 292 | Pass | Example |
| | 120 | 1.29 | Satisfied | 550 | 515 | Good | 799 | Pass | |
| | 120 | 1.87 | Satisfied | 550 | 505 | Good | 1008 | Pass | |
| | 0 | 0.00 | — | 550 | 495 | Good | 365 | Pass | |
| 4 | 0 | 0.00 | — | 550 | 495 | Good | 301 | Pass | Comparative example |
| | 60 | 0.65 | Unsatisfied | 550 | 570 | Poor | 735 | Fail | |
| | 240 | 2.99 | Unsatisfied | 550 | 505 | Good | 1012 | Pass | |
| | 0 | 0.00 | — | 550 | 492 | Poor | 361 | Pass | |

(Evaluation Results)

In the case of No. 1, when passing the Si-added high tensile strength steels B and C, no humidified gas was supplied and the value of the second part of the expression (1) was 0. Therefore, the internal oxidation of Si was insufficient, and a favorable coating appearance could not be obtained. In addition, the alloying temperature increased and the tensile strength decreased. In the case of No. 4, when passing the Si-added high tensile strength steel B, the value of the second part of the expression (1) was 0.65. Therefore, the internal oxidation of Si was insufficient, and a favorable coating appearance could not be obtained. In addition, the alloying temperature increased and the tensile strength decreased. Furthermore, when passing the Si-added high tension strength steel C, the value of the second part of the expression (1) was 2.99. Therefore, although the coating appearance of steel C was favorable, surface defects such as pick-up defects occurred in the subsequently passed steel D and the coating appearance thereof was impaired because it took time to change the dew point.

On the other hand, in the cases of Nos. 2 and 3, the humidified gas was supplied so as to satisfy the expression (1) during the passage of the Si-added high tensile strength steels B and C. Therefore, the steels B and C obtained a favorable coating appearance, and the subsequently passed steel D also obtained a favorable coating appearance.

INDUSTRIAL APPLICABILITY

According to the method for producing a galvannealed steel sheet and the continuous hot-dip galvanizing apparatus of this disclosure, it is possible to obtain high coating adhesion and a favorable coating appearance in the case of applying a hot-dip galvanized coating onto a steel sheet having a Si content of 0.2 mass % or more, and at the same time, to suppress the occurrence of pick-up defects by rapidly switching the dew point of the atmosphere in the soaking zone in the case of subsequently applying a hot-dip galvanized coating onto a steel sheet having a Si content of less than 0.2 mass % thereafter.

REFERENCE SIGNS LIST

100 continuous hot-dip galvanizing apparatus
10 heating zone
12 soaking zone
12A former part of the soaking zone
12B latter part of the soaking zone
14 first cooling zone (rapid cooling zone)
16 second cooling zone (slow cooling zone)
18 snout
20 annealing furnace
22 hot-dip galvanizing bath
23 alloying line
24 dry gas distribution device
26 humidifying device
28 constant-temperature circulating water bath
30 dry gas pipe
31 dry gas flow meter
32 dry gas supply port
39 humidified gas distribution device
40 and 43 humidified gas pipe
41 humidified gas flow meter
42 humidified gas dew point meter
44A to 44E humidified gas supply port
45A to 45E humidified gas supply port
46A to 46E humidified gas supply port
47A and 47B dew point measurement port
48 upper hearth roll
49 lower hearth roll
49E lower hearth roll on the exit side of the soaking zone
50 regulating valve
P steel sheet
$P_1$ most upstream position of the steel sheet portion of the length L from the exit side of the soaking zone

The invention claimed is:

1. A method for producing a galvannealed steel sheet using a continuous hot-dip galvanizing apparatus comprising a vertical annealing furnace in which a heating zone, a soaking zone and a cooling zone are arranged in the stated order, a hot-dip galvanizing apparatus positioned downstream of the cooling zone, and an alloying line positioned downstream of the hot-dip galvanizing apparatus, wherein the method comprises conveying a steel sheet inside the annealing furnace through the heating zone, the soaking zone, and the cooling zone in the stated order, and performing annealing on the steel sheet, where the steel sheet is conveyed vertically a plurality of times inside each zone to form a plurality of passes, applying a hot-dip galvanized coating onto the steel sheet discharged from the cooling zone using the hot-dip galvanizing apparatus, and heat-alloying the galvanized coating applied onto the steel sheet using the alloying line, wherein a plurality of humidified gas supply ports for supplying a reducing or a non-oxidizing humidified gas to the soaking zone, and at least one dry gas supply port for supplying a reducing or a non-oxidizing dry gas to the soaking zone are arranged in the soaking zone, and wherein the steel sheet first passing through the soaking zone has a Si content of 0.2 mass % or more, in this case both the dry gas and the humidified gas are supplied to the soaking zone, wherein the humidified gas is supplied only from a humidified gas supply port positioned in a latter part of the soaking zone among the plurality of humidified gas supply ports, where the latter part of the soaking zone is an area on the cooling zone side of a pass immediately upstream of a pass including a most upstream position of a steel sheet portion corresponding to L, where L is determined so as to satisfy the following expression (1)

$$1.0 \leq 10100L/V \exp\{-14560/(T+273.15)\} \leq 2.5 \quad (1)$$

where L[m] is a steel sheet length from an exit side of the soaking zone, V[m/s] is a sheet passing speed in a range of 1.0 m/s to 2.0 m/s, and T[° C.] is a target temperature on the exit side of the soaking zone in a range of 750° C. to 900° C., and wherein the steel sheet subsequently passing through the soaking zone has a Si content of less than 0.2 mass %, in this case only the dry gas is supplied to the soaking zone.

2. The method for producing a galvannealed steel sheet according to claim 1, wherein the steel sheet first passing through the soaking zone has a Si content of 0.2 mass % or more, in this case a dew point of furnace gas collected from a dew point measurement port positioned in the latter part of the soaking zone is controlled to −25° C. or higher and 0° C. or lower.

* * * * *